US010323637B2

(12) United States Patent
Chu

(10) Patent No.: US 10,323,637 B2
(45) Date of Patent: Jun. 18, 2019

(54) STEPPING MOTOR DRIVE APPARATUS, GEAR PUMP, AND STEPPING MOTOR-DRIVEN GEAR PUMP SYSTEM

(71) Applicant: Thermovision, Inc., Setauket, NY (US)

(72) Inventor: Mosi Chu, Setauket, NY (US)

(73) Assignee: Mosi Chu Irrevocable Trust, Setauket, NY (US)

( * ) Notice: Subject to any disclaimer, the term of this patent is extended or adjusted under 35 U.S.C. 154(b) by 384 days.

(21) Appl. No.: 15/185,588

(22) Filed: Jun. 17, 2016

(65) Prior Publication Data

US 2017/0363083 A1 Dec. 21, 2017

(51) Int. Cl.
*F04C 2/18* (2006.01)
*F04C 15/00* (2006.01)

(52) U.S. Cl.
CPC ..... *F04C 15/0061* (2013.01); *F04C 2/18* (2013.01); *F04C 15/008* (2013.01); *F04C 15/0019* (2013.01); *F04C 2240/20* (2013.01); *F04C 2240/30* (2013.01); *F04C 2240/40* (2013.01); *F04C 2240/50* (2013.01); *F04C 2240/60* (2013.01)

(58) Field of Classification Search
CPC ..... F16H 7/023; F16H 55/171; F16G 1/28; B65G 23/06; B01D 11/0207
USPC ..... 474/153
See application file for complete search history.

(56) References Cited

U.S. PATENT DOCUMENTS 295,906 A * 4/1884 Clapp ..... F16H 7/023 474/153
355,239 A * 12/1886 Wittmann et al. ..... F16H 7/023 474/153
649,563 A * 5/1900 Willson ..... F16H 7/023 474/153
811,134 A * 1/1906 Dufour ..... F16H 7/023 474/153
2,812,665 A * 11/1957 Shelor ..... F16H 7/06 474/148
2,934,967 A * 5/1960 Worrall, Jr. ..... F16G 1/28 474/148
2,987,932 A * 6/1961 Szonn ..... B65G 23/06 474/153
3,083,583 A * 4/1963 Szonn ..... B29D 29/08 474/153
3,313,166 A * 4/1967 Ulrich ..... F16G 1/28 474/148

(Continued)

*Primary Examiner* — Henry Y Liu
(74) *Attorney, Agent, or Firm* — Carter, DeLuca & Farrell, LLP

(57) ABSTRACT

A stepping motor-driven system includes a stepping motor, an output device, and a belt and pulley system operably coupling the stepping motor with the output device to impart rotation therebetween. The belt and pulley system includes an input pinion engaged with the stepping motor, an output pinion engaged with the output device, and a timing belt. The timing belt is disposed about the input and output pinions, inhibits elongation, and defines a plurality of spaced-apart grooves on an inwardly-facing surface thereof that are wider than the teeth of the pinions and are configured to receive the teeth of the pinions in meshed engagement therewith. As a result, a gap is defined within each groove. The gaps permit backlash of the timing belt in response to changes in a rotational speed input to the belt and pulley system from the stepping motor, thereby inhibiting loss of control.

12 Claims, 3 Drawing Sheets

(56) References Cited

U.S. PATENT DOCUMENTS 3,404,576 A * 10/1968 Cicognani ..... F16G 1/28 474/148
3,909,831 A * 9/1975 Marchio ..... B43L 13/024 118/679
3,996,812 A * 12/1976 Cappotto ..... F16G 1/28 474/153
4,007,644 A * 2/1977 Weinberger ..... F16G 1/28 474/148
4,037,705 A * 7/1977 Martin ..... B41J 11/40 101/93.05
4,041,789 A * 8/1977 Hoback ..... F16G 1/28 474/148
4,072,062 A * 2/1978 Morling ..... A01D 45/023 198/494
4,108,011 A * 8/1978 Gregg ..... F16G 1/28 474/153
RE30,440 E * 12/1980 Jeffrey ..... F16H 7/023 474/148
4,444,519 A * 4/1984 Howell ..... B41J 1/30 101/93.04
4,452,594 A * 6/1984 Patterson ..... F16H 7/023 474/153
4,554,499 A * 11/1985 Sherman ..... G05D 7/0676 137/3
5,027,706 A * 7/1991 Niemiro ..... B41F 31/027 101/148
5,136,515 A * 8/1992 Helinski ..... B29C 67/0059 264/122
5,421,789 A * 6/1995 Gregg ..... F16G 1/28 474/153
6,575,862 B2 * 6/2003 Miyaji ..... F16G 1/28 474/153
7,267,532 B2 * 9/2007 Krebs ..... F04C 2/086 417/420
7,277,770 B2 * 10/2007 Huang ..... B29C 41/02 216/27
7,752,965 B2 * 7/2010 Atwater ..... B41F 31/08 101/365
7,850,562 B2 * 12/2010 DeGroot ..... B65G 15/26 474/153
8,196,492 B1 * 6/2012 Denu ..... B25J 9/042 414/744.5
8,801,418 B2 * 8/2014 El-Siblani ..... B33Y 10/00 425/174.4
9,493,306 B2 * 11/2016 Niewmierzycki ..... H01L 21/67742
9,938,089 B2 * 4/2018 Voss ..... B01D 11/0207
2002/0113855 A1 * 8/2002 Baum ..... B41F 5/24 347/104
2005/0015175 A1 * 1/2005 Huang ..... B29C 41/02 700/121
2005/0181905 A1 * 8/2005 Ali ..... F02B 67/06 475/210
2006/0140793 A1 * 6/2006 Krebs ..... F04C 2/086 417/420
2008/0302260 A1 * 12/2008 Atwater ..... B41F 31/08 101/366
2010/0330216 A1 * 12/2010 Hurt ..... B29C 47/92 425/67
2012/0010040 A1 * 1/2012 Sappenfield ..... F16H 37/0806 475/331
2012/0180586 A1 * 7/2012 Sappenfield ..... A61C 17/26 74/412 R
2013/0153123 A1 * 6/2013 Pasch ..... B29D 29/08 156/138
2014/0151195 A1 * 6/2014 Niewmierzycki ..... H01L 21/67742 198/813
2015/0040554 A1 * 2/2015 Smith ..... F04B 49/12 60/446
2016/0009503 A1 * 1/2016 Voss ..... B01D 11/0207 414/222.07
2018/0149669 A1 * 5/2018 Voss ..... B01L 3/50

* cited by examiner

STEPPING MOTOR DRIVE APPARATUS, GEAR PUMP, AND STEPPING MOTOR-DRIVEN GEAR PUMP SYSTEM

BACKGROUND

Technical Field

The present disclosure relates to motor drive apparatus and motor-driven systems. More specifically, the present disclosure relates to a stepping motor drive apparatus, a gear pump, and a stepping motor-driven gear pump system configured to maximize efficiency.

Background of Related Art

A stepping motor by its structure has a permanent magnet toothed rotor, and when interacting with the windings on the stator, is characterized by a natural frequency. This function consists of the electrical current, pitch of the teeth, and rotor moment of inertia. A stepping motor has a power input, in the form of current pulses, and its stability depends on the power input. If the input is not adequate, the stepping motor can suddenly lose torque causing the rotor to oscillate at its natural frequency. The result is a loss of control.

In order to account for the above problem, some stepping motor systems incorporate an optical encoder with feedback circuitry to inhibit the loss of torque, thus preventing oscillation of the rotor at its natural frequency, and, ultimately, loss of control. Without an optical encoder, typical stepping motor systems would not be capable of high speed starts and stops with precise stop locations, as these systems would be susceptible to loss of control.

It would therefore be desirable to provide a stepping motor drive apparatus and stepping motor-driven system, e.g., incorporating a gear pump our other suitable device to be driven by the stepping motor, that is capable of high speed starts and stops with precise stop locations without the need for an optical encoder.

SUMMARY

Provided in accordance with aspects of the present disclosure is a stepping motor-driven system including a stepping motor, an output device, and a belt and pulley system. The stepping motor includes a rotor configured to rotate in response to driving of the stepping motor. The output device includes a drive shaft. The belt and pulley system operably couples the rotor of the stepping motor with the drive shaft of the output device such that rotation of the rotor effects rotation of the drive shaft. The belt and pulley system, more specifically, includes an input pinion an output pinion, and a timing belt. The input pinion is engaged with the rotor of the stepping motor and defines a plurality of spaced-apart, annularly arranged first teeth disposed on an outer surface thereof. Each of the first teeth defines a first width. The output pinion is engaged with the drive shaft of the output device and defines a plurality of spaced-apart, annularly arranged second teeth disposed on an outer surface thereof. Each second tooth defines a second width equal to the first width. The timing belt is disposed about the input pinion towards a first end of the timing belt and disposed about the output pinion towards a second end of the timing belt. The timing belt is configured to inhibit elongation and defines a plurality of spaced-apart grooves on an inwardly-facing surface thereof. Each groove of the timing belt defines a third width greater than each of the first and second widths.

The first and second teeth of the input and output pinions are disposed in meshed engagement within the grooves of the timing belt such that, as a result of the third width being greater than each of the first and second widths, a gap is defined within each groove. The gaps permit backlash of the timing belt in response to changes in a rotational speed input to the belt and pulley system from the stepping motor, thereby inhibiting loss of control.

In an aspect of the present disclosure, the stepping motor, the belt and pulley system, and the output device are configured such that a moment of inertia defined by the stepping motor is equal to a moment of inertia defined collectively by the belt and pulley system and the output device.

In another aspect of the present disclosure, the backlash of the timing belt dissipates energy from the timing belt to inhibit loss of control.

In still another aspect of the present disclosure, energy is built up in the timing belt in response to acceleration of the stepping motor. The built up energy is dissipated from the timing belt via the backlash of the timing belt.

In yet another aspect of the present disclosure, the stepping motor is configured to switch from an accelerating mode to a constant-speed mode to inhibit reaching a resonance condition. The backlash of the timing belt occurs upon switching of the stepping motor to the constant-speed mode.

In another aspect of the present disclosure, the stepping motor is configured to switch from the accelerating mode to the constant-speed mode according to a start/stop profile of the stepping motor.

In still another aspect of the present disclosure, when excess energy is built up in the timing belt, the excess energy is dissipated by way of transverse waves in the timing belt.

In yet another aspect of the present disclosure, the belt and pulley system further includes a set of rollers positioned adjacent the timing belt and configured to maintain the timing belt tight and engaged with the input and output pinions and inhibit the effects of the transverse waves.

In still yet another aspect of the present disclosure, the set of rollers inhibits transverse motion of the timing belt in response to the transverse waves and, as a result, energy is dissipated from the timing belt via the backlash of the timing belt.

In another aspect of the present disclosure, the output device is a gear pump. In such aspects, the gear pump may include an enclosure defining a chamber, a drive gear rotatably mounted within the chamber, a passive shaft rotatably mounted within the chamber, and a passive gear engaged about the passive shaft and disposed in meshed engagement with the drive gear. The drive shaft extends into the chamber to engage the drive gear.

In still another aspect of the present disclosure, the rotor of the stepping motor, the input and output pinions of the belt and pulley system, and the drive and passive gears of the gear pump are configured such that a moment of inertia defined by the stepping motor is equal to a moment of inertia defined collectively by the belt and pulley system and the gear pump.

In another aspect of the present disclosure, the drive shaft and the passive shaft are sealingly engaged with the enclosure of the gear pump via ball bearing assemblies.

In aspects of the present disclosure, the stepping-motor is a permanent magnet stepping motor. In such aspects, the permanent magnet stepping motor is driven by pulses of electrical energy. Further, a rate of input of the pulses of electrical energy determines a speed output of the stepping motor.

BRIEF DESCRIPTION OF THE DRAWINGS

Aspects and features of the present disclosure are described herein with reference to the accompanying drawings, wherein.

DETAILED DESCRIPTION

Figure 1A:
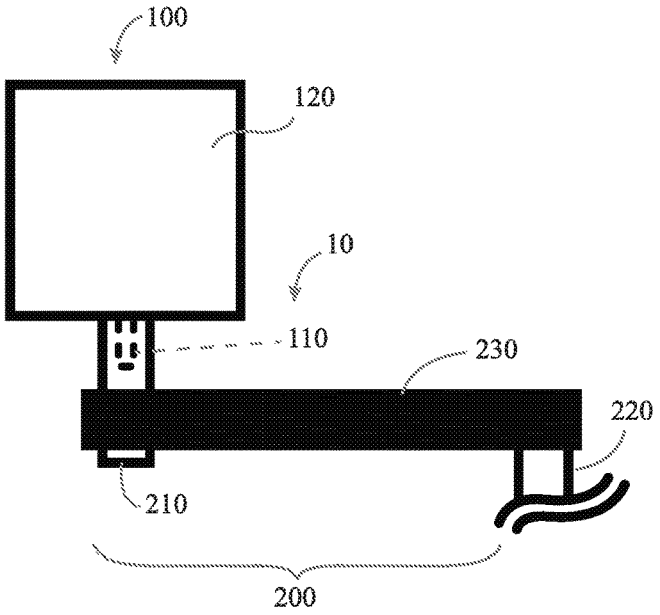
FIG. 1A is a top view of a stepping motor drive apparatus provided in accordance with the present disclosure.

Various embodiments of the present disclosure will now be described in detail with reference to the drawings, wherein like reference numerals identify similar or identical elements. In the following description, well known functions or constructions are not described in detail to avoid obscuring the present disclosure. To the extent consistent, any of the aspects and/or features of any of the embodiments detailed herein may be used in conjunction with any of the aspects and/or features of any of the other embodiments detailed herein.

Figure 1B:
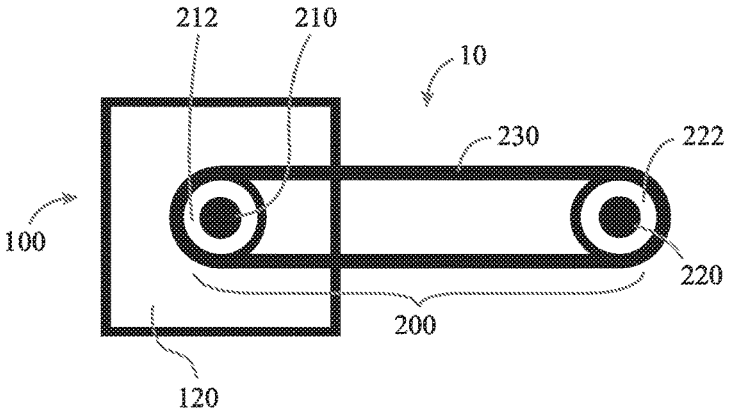
FIG. 1B is a side view of the stepping motor drive apparatus of FIG. 1A.

Turning to FIGS. 1A and 1B, a stepping motor drive apparatus 10 provided in accordance with the present disclosure generally includes a stepping motor 100 and a belt and pulley system 200 operably coupled to stepping motor 100. Stepping motor 100 may be any suitable stepping motor that converts electrical pulses (measured in pulses per second (PPS)) into mechanical shaft rotations, for example, a permanent magnet (PM) stepping motor having a PM rotor 110 and a stator body 120 surrounding PM rotor 110 for driving rotation thereof in response electrical pulses input thereto. PM rotor 110 defines a moment of inertia.

Belt and pulley system 200 includes an input shaft 210, an input pinion 212, an output shaft 220, an output pinion 222, and a timing belt 230. Input shaft 210 is engaged with PM rotor 110 of stepping motor 100 such that rotation of PM motor 110 drives corresponding rotation of input shaft 210. Input pinion 212 is engaged about input shaft 210 and defines a plurality of teeth disposed annularly about the outer periphery thereof. Alternatively, rather than providing a separate input pinion 212, teeth may be define annularly about the outer periphery of input shaft 210 along the length thereof such that input shaft 210 also functions as the input pinion.

Figure 5:
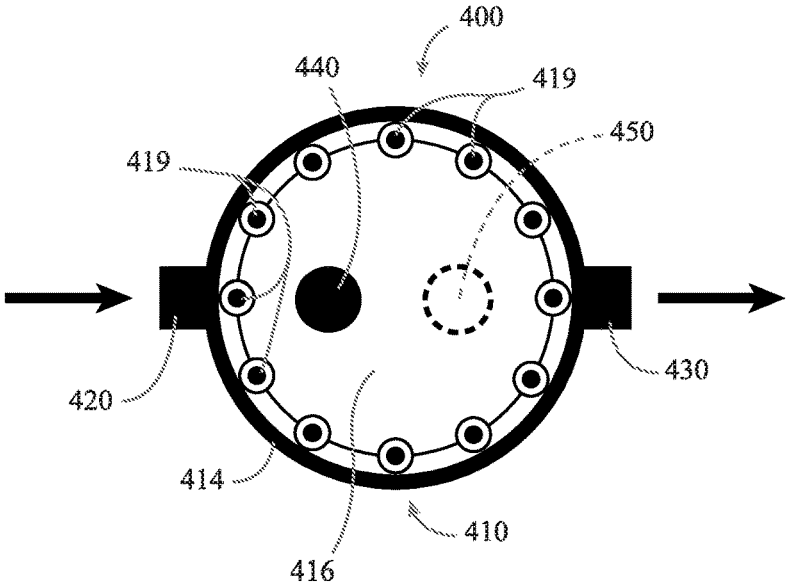
FIG. 5 is a front view of a gear pump provided in accordance with the present disclosure and configured for use with the stepping motor drive apparatus of FIG. 1A to form a stepping motor-driven gear pump system.
Figure 6:
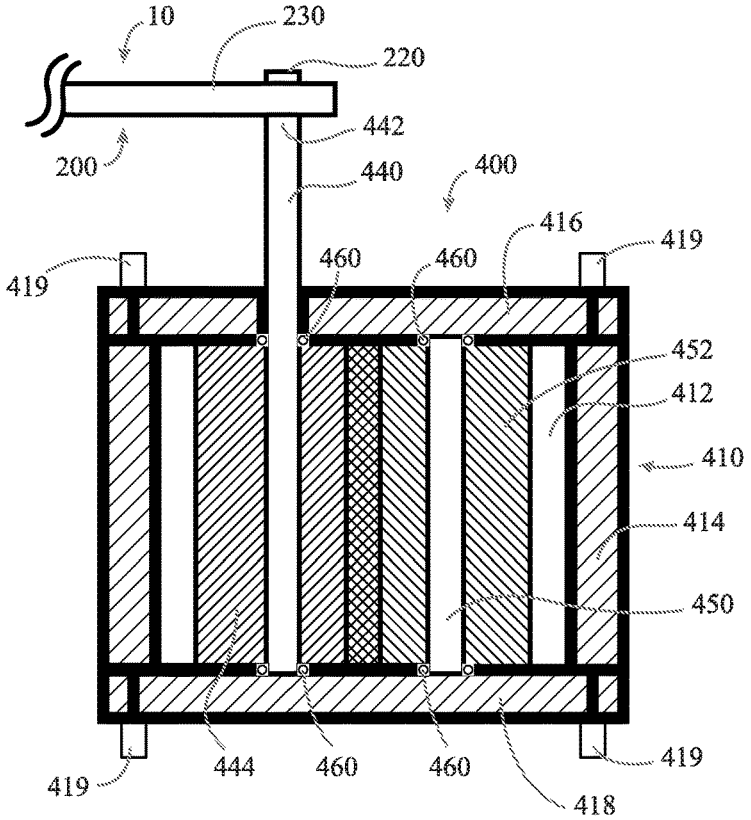
FIG. 6 is a cross-sectional view of the stepping motor-driven gear pump system of FIG. 5.
Figure 7:
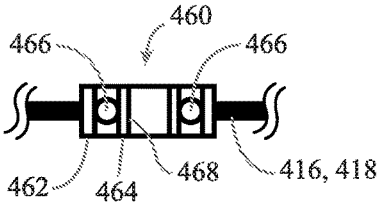
FIG. 7 is an enlarged, cross-sectional view of one of the bearing assemblies of the gear pump of FIGS. 5 and 6.
Figure 8:
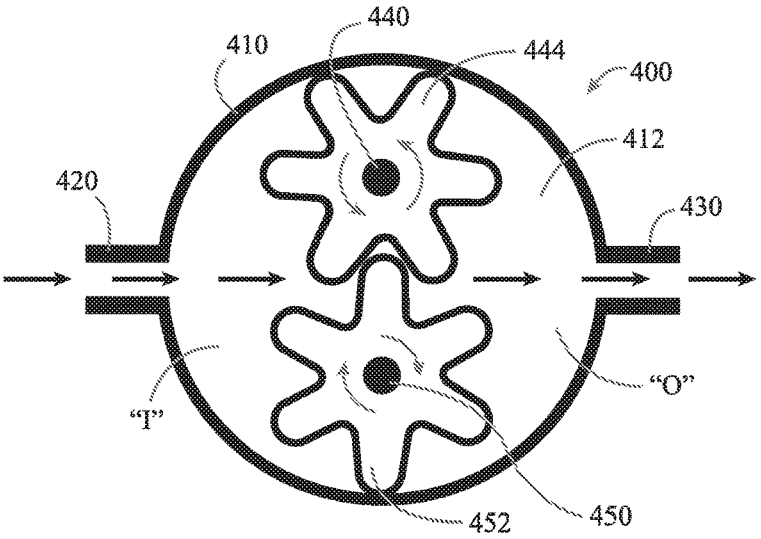
FIG. 8 is a cross-sectional illustration of the operation of the gear pump of FIGS. 5 and 6.

Output shaft 220 includes output pinion 222 engaged thereabout and defining a plurality of teeth 224 disposed annularly about the outer periphery thereof. Output shaft 220 is configured to engage an output device to be driven by stepping motor 100, e.g., gear pump 400 (FIGS. 5, 6, and 8). Similarly as above, rather than providing a separate output pinion 222, teeth 224 may be define annularly about the outer periphery of output shaft 220 along the length thereof such that output shaft 220 also functions as the output pinion.

Timing belt 230 operably couples input and output shafts 210, 220, respectively, such that rotation imparted from stepping motor 100 to input shaft 210 effects rotation of output shaft 220 to thereby drive the output device. In some embodiments, multiple timing belts 230 may be provided at spaced-apart positions along input and output shafts 210, 220 and each operably engaged therewith via input and output pinions 212, 222, respectively. Timing belt 230 includes a plurality of grooves 232 configured to engage the teeth 224 (only teeth 224 of output pinion 220 are shown; the teeth of input pinion 210 are similar) of input and output pinions 212, 222 such that rotation of input pinion 212 in response to rotation of input shaft 210 via stepping motor 100 rotates timing belt 230 to thereby rotate output pinion 222 which, in turn, rotates output shaft 220 to drive the output device.

As noted above, timing belt 230 operably couples input and output pinions 212, 222, respectively. Input and output pinions 212, 222, respectively, may define different diameters, different pitches, and/or different teeth configurations to achieve a desired gear ratio of belt and pulley system 200. In particular, the gear ratio of belt and pulley system 200 may be selected such that the moment of inertia of belt and pulley system 200 (including the output device) equals the moment of inertia of PM rotor 110 of stepping motor 100, thus optimizing efficiency and performance.

In some embodiments, timing belt 230 is made of a flexible rubber compound with high strength fibers embedded inside the rubber. This configuration inhibits elongation of timing belt 230 while still providing a flexible configuration. Other materials and/or configurations for forming timing belt 230 that provide flexibility but inhibit elongation are also contemplated. Input and output pinions 212, 222 and/or input and output shafts 210, 220 (whether integrating input and output pinions 212, 222 therein or separate therefrom) may be formed from made of a metallic material, e.g., extruded aluminum.

Figure 2:
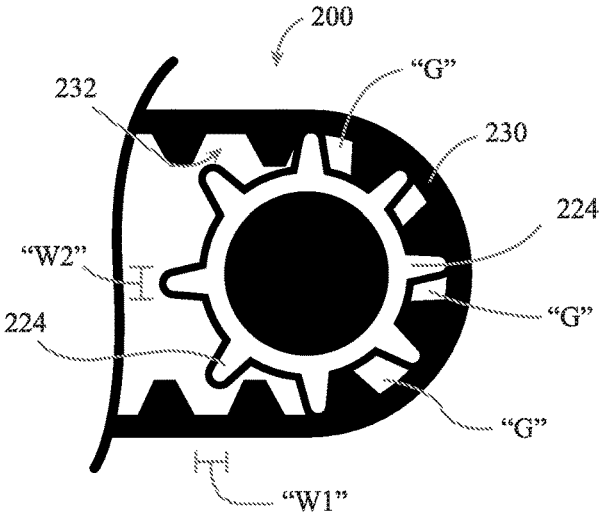
FIG. 2 is an enlarged, side view of one end of the belt and pulley assembly of the stepping motor drive apparatus of FIG. 1A.

With additional reference to FIG. 2, grooves 232 defined within timing belt 230 define a width "W1" that is greater than a width "W2" of teeth 224 of output pinion 222 and also the teeth (not shown, similar to teeth 224) of input pinion 212. As a result of this configuration, a gap "G" is defined between the more-narrow teeth 224 of input and output pinions 212, 222 and one of the walls of the corresponding groove 232 of timing belt 230. This gap "G" enables backlash, the importance of which is detailed below. Further, due to the above-detailed configuration, one portion of the timing belt 230 is tensioned while the opposite portion is relaxed. For example, when stepping motor 100 is operating to drive input shaft 210 to rotate counterclockwise from the orientation shown in FIG. 1B, the upper portion of timing belt 230 is tensioned via the engagement of the teeth of input pinion 212 within grooves 232 of timing belt 230 so as to pull the upper portion of timing belt 230 towards input pinion 212. However, the lower portion of timing belt 230 is relaxed. On the other hand, when stepping motor 100 is operating to drive input shaft 210 to rotate clockwise from the orientation shown in FIG. 1B, the lower portion of timing belt 230 is tensioned via the engagement of the teeth of input pinion 212 within grooves 232 of timing belt 230 so as to pull the lower portion of timing belt 230 towards input pinion 212. However, the upper portion of timing belt 230 is relaxed.

Continuing with reference to FIGS. 1A, 1B, and 2, if stepping motor 100 is driven to accelerate, the tensioned portion of timing belt 230 is increasingly pulled, imparting more and more energy to timing belt 230. Since timing belt 230 is constructed to inhibit elongation, excessive energy would either snap timing belt 230 or seek to find another path to dump the excess energy. By nature, this path is the least resistance path. For stepping motor 100, the least resistance path is the natural frequency of stepping motor 100. For timing belt 230, the least resistance path is a transverse wave on the tensioned portion of timing belt 230, which vibrates perpendicularly to timing belt 230.

Figure 4:
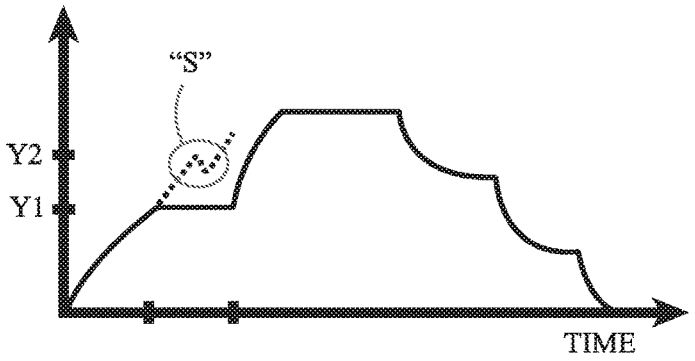
FIG. 4 is a graph illustrating an exemplary start/stop profile of a stepping motor.

With additional reference to FIG. 4, an accelerating stepping motor, e.g., stepping motor 100, is susceptible to a speed trap "S," which occurs when a resonance condition is achieved. More specifically, when the stepping rate or PPS input to stepping motor 100 is increased to accelerate stepping motor 100 to, for example, a PPS input "Y2," at a sufficiently aggressive rate, stepping motor 100 encounters a resonance, or speed trap "S," which causes stepping motor 100 to oscillate at its natural frequency and generate transverse waves and, thus, may result in loss of control of stepping motor 100. Excess energy in timing belt 230 also results in transverse waves on the tensioned portion of timing belt 230, which may ultimately result in disengagement of timing belt 230 from input pinion 212 and/or output pinion 222 and, thus, loss of control of stepping motor drive apparatus 10. This loss of control may be evident by audible sounds created by the transverse waves in timing belt 230.

In order to inhibit occurrence of the speed trap "S," the PPS input to stepping motor 100 may be switched from an accelerating condition to a constant speed condition for a short period of time, prior to reaching the speed trap "S," e.g., at PPS input of "Y1" which is less than "Y2." Upon switching to constant speed, the energy building up in timing belt 230 is lost via backlash in timing belt 230. As noted above and as illustrated in FIG. 2, due to the difference in widths ("W1" vs. "W2") between teeth 224 of input and output pinions 212, 222 and grooves 232 of timing belt 230, backlash is permitted, wherein relative motion within the gap "G" between input and output pinions 212, 222 and timing belt 230 is realized to release the energy therefrom.

Once the energy is dissipated via backlash in timing belt 230, the PPS input to stepping motor 100 may again be increased, allowing stepping motor 100 to accelerate towards its peak speed. This switching from an accelerating condition to a constant speed condition to enable backlash and dissipation of energy from timing belt 230 may occur one or more times, depending upon the start/stop profile of the particular stepping motor 100 utilized, as some stepping motors may have more than one speed trap "S." The start/stop profile of a particular stepping motor 100, from which the speed traps "S" may be determined, are typically available in the specifications provided by the manufacturer of the stepping motor 100.

When stepping motor 100 is decelerated and approaches a stop point, the PPS input is cut-off and the stored energy in timing belt 230 is drained via backlash. This results in the stop point being precise and repeatable, unlike rigid systems that do not permit backlash, which continue to oscillate after the stop point has been reached. Thus, providing a belt and pulley system 200 that enables backlash allows for more precise control of stepping motor 100, e.g., allowing stepping motor 100 to accelerate from point-to-point with the least time consumed and allowing stepping motor 100 to reach stop points without observable error.

Figure 3:
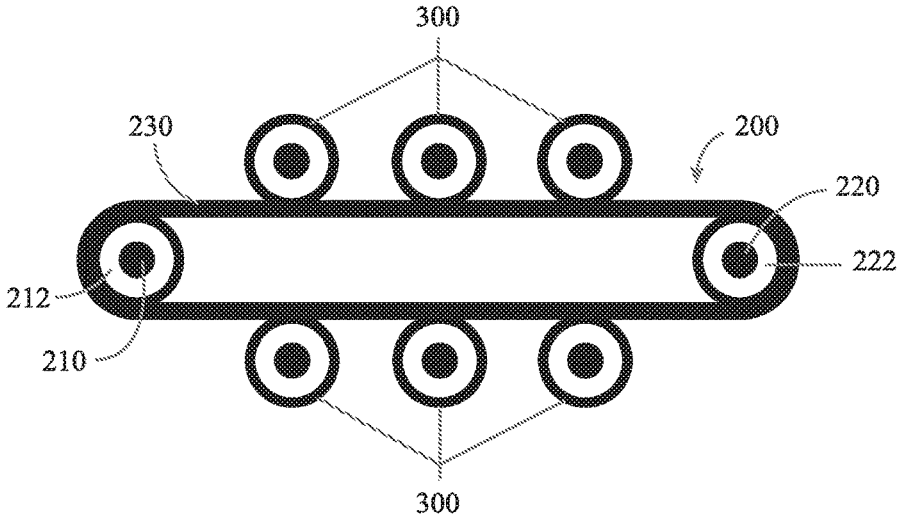
FIG. 3 is a side view of the belt and pulley assembly of the stepping motor drive apparatus of FIG. 1A, including a plurality of support rollers operably positioned relative to the belt pulley assembly.

Turning to FIG. 3, in conjunction with FIGS. 1A-2, as an alternative or in addition to switching to a constant-speed condition in order to inhibit reaching a speed trap "S," as detailed above and as illustrated in FIG. 4, the amplitude of the transverse waves of timing belt 230 may be minimized by keeping timing belt 230 tight and engaged with input and output pinions 212, 222, respectively, using a set of rollers 300. A suitable number and/or configuration of rollers 300 are positioned on the opposing upper and lower portions of timing belt 230 to ensure timing belt 230 is maintained in engagement with input and output pinions 212, 222, respectively. This configuration, in combination with the backlash configuration of belt and pulley system 200, inhibits excursions of timing belt 230 as a result of the transverse waves and, thus, helps maintain control of stepping motor 100. In particular, rather than through transverse waves, the built up energy in timing belt 230 is dissipated via backlash, while timing belt 230 is maintained in engagement with input and output pinions 212, 222, respectively.

Referring generally to FIGS. 1A and 1B, in embodiments, the configuration of belt and pulley system 200 may be selected based upon a particular purpose, for example, the magnitude of the load to be driven by stepping motor drive apparatus 10. For lighter loads, a narrower timing belt 230 could be utilized, while, for heavier loads, a wide timing belt 230 or sleeve may be utilized. Timing belt 230 may also include grooves 232 on the exterior surface thereof for engaging loads thereon or for other purposes.

Turning now to FIGS. 5-8, a gear pump provided in accordance with the present disclosure and configured for use with stepping motor drive apparatus 10 (FIGS. 1A and 1B) as part of a stepping-motor driven system is identified by reference numeral 400. Gear pump 400 generally includes an enclosure 410 defining a chamber 412, an input 420 in communication with the chamber 412, an output 430 in communication with the chamber 412 opposite the input 420, a drive shaft 440 extending through enclosure 410 and into chamber 412, a passive shaft 450 disposed within chamber 412 of enclosure 410 and meshed with drive shaft 440, and a plurality of ball bearing assemblies 460.

Enclosure 410 is formed from a tubular body 414 defining an interior lumen, and end covers 416, 418 sealingly engaged about the open ends of tubular body 414 via bolts 419. Bolts 419 are engaged annularly about end covers 416, 418 and tubular body 414 so as to seal the interior lumen, thus defining chamber 412 within enclosure 410. Tubular body 414 and end covers 416, 418 are formed from stainless steel such that corrosion is inhibited, although other materials are also contemplated. Further, tubular body 414 and end covers 416, 418 are relatively thin-walled plate-like structures.

Input 420 and output 430 are defined through tubular body 414 of enclosure 410. Input 420 is configured to connect to a fluid source for supplying fluid to gear pump 400. Gear pump 400 is configured to selectively pump the fluid received from the fluid source out through output 430.

Drive shaft 440 extends through an aperture defined within one of the end covers 416, 418 of enclosure 410 and into chamber 412. Drive shaft 440 defines an exterior end 442 that includes teeth defined thereon or a pinion mounted thereon that includes teeth, thus allowing drive shaft 440 to operably coupled to timing belt 230 of stepping motor drive apparatus 10 (see FIGS. 1A and 1B). In other words, in this system, drive shaft 440 serves as the output shaft 220 of stepping motor drive apparatus 10 (see FIGS. 1A and 1B).

Drive shaft 440 extends transversely through chamber 412 of enclosure 410 and is sealingly engaged thereto at either side of chamber 412 via one of the ball bearing assemblies 460. Within chamber 412, drive shaft 440 includes a drive gear 444 engaged thereabout. In response to driving of stepping motor drive apparatus 10 (see FIGS. 1A and 1B), drive shaft 440 is rotated, thereby rotating drive gear 444 within and relative to chamber 412.

Passive shaft 450 extends transversely through chamber 412 of enclosure 410 and is sealingly engaged thereto at either side of chamber 412 via one of the ball bearing assemblies 460. Passive shaft 450 includes a passive gear 452 engaged thereabout and disposed in meshed engagement with drive gear 444. Thus, in response to driving of stepping motor drive apparatus 10 (see FIGS. 1A and 1B) drive gear 444 is rotated within and relative to chamber 412 thereby rotating passive gear 452 within and relative to chamber 412.

As best illustrated in FIG. 8, drive gear 444 and passive gear 452 are meshed in sealing engagement with one another and diametrically opposed thereto are sealingly engaged with the interior wall of enclosure 410 that defines chamber 412. Thus, fluid, e.g., water, is inhibited from passing between or around gears 444, 452 from the input side "I" of chamber 412 to the output side "O" of chamber 412 when gears 444, 452 are stationary. Rather, only when gears 444, 452 are driven to rotate is fluid pumped between or around gears 444, 452 from the input side "I" to the output side "O." Put more generally, driving of drive shaft 440 by stepping motor drive apparatus 10 (see FIGS. 1A and 1B) pumps fluid from the input 420 of gear pump 400, through chamber 412 of enclosure 410, and out the output 430 of gear pump 400.

As noted above, and with reference to FIG. 7, drive shaft 440 and passive shaft 450 are sealingly engaged with enclosure 410 via ball bearing assemblies 460. Ball bearing assemblies 460 establish a fluid-tight seal while still permitting rotation of drive shaft 440 and passive shaft 450 relative to enclosure 410. Each ball bearing assembly 460 includes an outer ring 462, an inner ring 464, and a plurality of ball bearings 466 disposed therebetween to permit relative rotation between outer ring 462 and inner ring 464. Each ball bearing assembly 460 is pressed into the interior surface of one of the end covers 416, 418. The four ball bearing assemblies 460 define bores plugged with a thin-walled tube 468. The thin-walled tubes 468 engage the ends of passive shaft 450, the interior end of drive shaft 440, and the portion of drive shaft 440 that extends through end cover 416. As such, the gear pump 400 is sealed and leakage is prevented.

To optimize efficiency and performance, as mentioned above, the gear pump 400 together with belt and pulley system 200 are configured such that the moment of inertia thereof equals the moment of inertia of PM rotor 110 of stepping motor 100 (see FIGS. 1A and 1B).

It will be understood that various modifications may be made to the embodiments of the present disclosure. Therefore, the above description should not be construed as limiting, but merely as exemplifications of embodiments. Those skilled in the art will envision other modifications within the scope and spirit of the present disclosure.

What is claimed is:

1. A stepping motor-driven system, comprising:

a stepping motor including a rotor configured to rotate in response to driving of the stepping motor, the stepping motor defining at least one speed trap corresponding to a resonance condition, the stepping motor configured to drive the rotor according to a start/stop profile in order to avoid the at least one speed trap;

an output device including a drive shaft; and a belt and pulley system operably coupling the rotor of the stepping motor with the drive shaft of the output device such that rotation of the rotor effects rotation of the drive shaft, the belt and pulley system including:

an input pinion engaged with the rotor of the stepping motor, the input pinion defining a plurality of spaced-apart, annularly arranged first teeth disposed on an outer surface of the input pinion, each tooth defining a first width;

an output pinion engaged with the drive shaft of the output device, the output pinion defining a plurality of spaced-apart, annularly arranged second teeth disposed on an outer surface of the output pinion, each second tooth defining a second width equal to the first width; and a timing belt, disposed about the input pinion towards a first end of the timing belt and disposed about the output pinion towards a second end of the timing belt, the timing belt configured to inhibit elongation and defining a plurality of spaced-apart grooves on an inwardly-facing surface thereof, each groove defining a third width greater than each of the first and second widths, wherein the first and second teeth of the input and output pinions are disposed in meshed engagement within the grooves of the timing belt such that, as a result of the third width being greater than each of the first and second widths, a gap is defined within each groove, the gaps permitting backlash of the timing belt in response to changes in a rotational speed input to the belt and pulley system from the stepping motor, wherein, in accordance with the start/stop profile, the stepping motor is configured to switch from an accelerating mode to a constant-speed mode prior to reaching the resonance condition, thereby avoiding the at least one speed trap and inhibiting loss of control, wherein switching to the constant-speed mode enables backlash of the timing belt, thereby dissipating energy built up in the timing belt during operation of the stepping motor in the accelerating mode, and wherein, in accordance with the start/stop profile, the stepping motor is configured to switch back to the accelerating mode after dissipating the energy built up in the timing belt.

2. The stepping motor-driven system according to claim 1, wherein the stepping motor, the belt and pulley system, and the output device are configured such that a moment of inertia defined by the stepping motor is equal to a moment of inertia defined collectively by the belt and pulley system and the output device.

3. The stepping motor-driven system according to claim 1, wherein, when excess energy is built up in the timing belt, the excess energy is dissipated by way of transverse waves in the timing belt.

4. The stepping motor-driven system according to claim 3, wherein the belt and pulley system further comprises a set of rollers positioned adjacent the timing belt and configured to maintain the timing belt tight and engaged with the input and output pinions and inhibit the effects of the transverse waves.

5. The stepping motor-driven system, wherein the set of rollers inhibits transverse motion of the timing belt in response to the transverse waves and, as a result, energy is dissipated from the timing belt via the backlash of the timing belt.

6. The stepping motor-driven system according to claim 1, wherein the output device is a gear pump.

7. The stepping motor-driven system according to claim 6, wherein the gear pump includes an enclosure defining a chamber, a drive gear rotatably mounted within the chamber, a passive shaft rotatably mounted within the chamber, and a passive gear engaged about the passive shaft and disposed in meshed engagement with the drive gear, wherein the drive shaft extends into the chamber to engage the drive gear.

8. The stepping motor-driven system according to claim 7, wherein the rotor of the stepping motor, the input and output pinions of the belt and pulley system, and the drive and passive gears of the gear pump are configured such that a moment of inertia defined by the stepping motor is equal to a moment of inertia defined collectively by the belt and pulley system and the gear pump.

9. The stepping motor-driven system according to claim 7, wherein the drive shaft and the passive shaft are sealingly engaged with the enclosure via ball bearing assemblies.

10. The stepping motor-driven system according to claim 1, wherein the stepping-motor is a permanent magnet stepping motor.

11. The stepping motor driven-system according to claim 10, wherein the permanent magnet stepping motor is driven by pulses of electrical energy.

12. The stepping motor driven-system according to claim 11, wherein a rate of input of the pulses of electrical energy determines a speed output of the stepping motor.

* * * * *